US005178665A

United States Patent [19]

Haque

[11] Patent Number: 5,178,665

[45] Date of Patent: Jan. 12, 1993

[54] RECOVERY OF DISSOLVED GOLD BY SODIUM BOROHYDRIDE ($NABH_4$) REDUCTION

[75] Inventor: Kazi E. Haque, Ottawa, Canada

[73] Assignee: Her Majesty the Queen in Right of Canada as represented by the Minister of Energy, Mines and Resources, Ottawa, Canada

[21] Appl. No.: 649,387

[22] Filed: Jan. 30, 1991

[30] Foreign Application Priority Data

Mar. 30, 1990 [CA] Canada ..... 2013536

[51] Int. Cl.[5] ..... C22B 11/00

[52] U.S. Cl. ..... 75/428; 75/741

[58] Field of Search ..... 75/428

[56] References Cited

U.S. PATENT DOCUMENTS 4,096,316 6/1978 Tamai et al. ..... 75/370
4,913,730 4/1990 Deschenes et al. ..... 75/370
4,992,200 2/1991 Lin et al. ..... 423/24

FOREIGN PATENT DOCUMENTS 1197986 12/1985 Canada ..... 75/741
158828 12/1981 Japan ..... 75/741

OTHER PUBLICATIONS 55-15828, Japan Abstracts, Dec. 7, 1981.

*Primary Examiner*—Melvyn J. Andrews
*Attorney, Agent, or Firm*—Sughrue, Mion, Zinn, Macpeak & Seas

[57] ABSTRACT

A process is disclosed for the direct recovery of gold from cyanide leach liquor, thiourea leach liquor or Bio-D leach liquor. The process comprises reduction precipitation of the gold from solution by the addition of stabilized alkali metal borohydride, preferably sodium, potassium, lithium or ammonium borohydride, at ambient temperature and pressure. High purity gold is obtained by heating the reduced precipitate to about 1200° C. The barren solution is in a condition such that it can be recycled to the upstream process.

10 Claims, No Drawings

RECOVERY OF DISSOLVED GOLD BY SODIUM BOROHYDRIDE ($NABH_4$) REDUCTION

BACKGROUND OF THE INVENTION

1. Field of the Invention

This invention relates to a process for the recovery of high purity metallic gold from non-toxic liquids, such as leach liquor resulting from the leaching of gold-containing ore.

2. Description of the Related Art

Hitherto, there have existed two principal methods of recovering gold from gold ores or gold concentrates. The first method involves cyanidation followed by the Merill-Crowe process wherein gold is recovered from solution by cementation with zinc powder which must then be refined to obtain gold metal. The process offers high gold recovery, but with low purity. The second method comprises cyanidation followed by recovery using activated carbon and electrolysis. The carbon-in-pulp (CIP) process involves contact between the activated carbon and leached pulp. Absorption of thiourea and other impurities onto the carbon and the difficulties of desorption of the gold are distinct disadvantages of this process. The carbon-in-leach (CIL) process involves loading the gold onto the carbon during leaching. In both the CIL and CIP processes, the precious metal must be eluted and passed to an electrowinning step for gold recovery. Gold recovered on the cathode then requires further refining. The activated carbon can be regenerated and then recycled.

Each of the these prior methods involves cyanidation. Because of the toxicity of cyanide, additional steps are required for its handling and subsequent elimination. This significantly increases the operating costs of these processes.

A recently proposed non-toxic alternative to cyanide for leaching gold ore or gold concentrate is thiourea. However, thus far, there is no well established method of recovering gold from non-toxic reagents such as thiourea solution. Attempts have been made to recover gold by thiourea leaching followed by precious metal recovery from solution by aluminum cementation, activated carbon, ion exchange, solvent extraction and electrolysis. These prior attempts have been expensive, requiring intermediate steps for concentrating and refining. As well, there is often thiourea decomposition during gold recovery from the pregnant solution which adds cost by decreasing the amount of barren thiourea that can be recycled.

Presently, thiourea is being used as an effective eluate for gold resin loaded with gold cyanide complex as a stripping agent for gold from the organic solvent loaded with gold from cyanide media. However, no satisfactory method has been developed to recover gold from such solutions.

One method of recovering gold from such thiourea solutions involves neutralizing the acidified thiourea solution to a pH of about 6.5 which results in the precipitation of gold due to pH change. However, the method is non-selective and uneconomical due to the acid consumption necessary to readjust the solution pH if the thiourea is to be recycled. As well, thiourea is relatively unstable at a pH above 4.

Hydrogen reduction is another method that has been used to recover gold from thiourea solution. This process requires high temperatures and pressures and the use of a catalyst which contributes to high operating costs. As well, the reaction kinetics are quite slow.

Electrolytes have also been used to recover gold from thiourea solution on a commercial basis. This method requires an elaborate two-stage electrolysis circuit with special cell design in order to obtain sufficiently high recoveries.

The reducing power of sodium borohydride has long been exploited for industrial applications such as pollution control and the removal and/or recovery of various metal cations from solution. Currently, sodium borohydride is finding application in the recovery of silver from spent photographic liquor (thiosulfate solution), as disclosed in U.S. Pat. No. 3,082,079, or spent electrolyte and platinum group metals from acidic leach liquor. Also, heavy metal cations such as $Cu^{2+}$, $Fe^{3+/2+}$, $Ni^{2+}$, $Hg^{2+}$, $Co^{2+}$ and $Pb^{2+}$ can be removed from toxic effluents by sodium borohydride treatment. However, there has been no suggestion of a sodium borohydride reduction process for the recovery of gold from leach liquors. Dietz, Jr. et al (Canadian Patent No. 1,090,584) teach a reduction precipitating agent containing aluminum, an alkali metal borohydride and a hydrazine compound for recovering precious metal values including gold from aqueous alkaline cyanide solutions. This prior process suffers from cyanide effluent problems as well as material losses due to necessity of cyanide effluent destruction.

SUMMARY OF THE INVENTION

It is an object of this invention to provide a simple and economic method for recovering high purity metallic gold directly from leach liquor including thiourea and acidic bromide leach liquors.

Accordingly, the invention provides a process for recovering metallic gold from an acidic solution containing gold values, which comprises: adding to the solution an alkali borohydride, preferably sodium, potassium, lithium or ammonium borohydride, in an amount at least stoichiometrically equal to the amount of gold compound in solution to cause precipitation, separating the metallic precipitate from the solution, and heating the precipitate to obtain high purity metallic gold.

DETAILED DESCRIPTION OF THE INVENTION

In a preferred embodiment of invention, a gold-containing aqueous solution from acidic thiourea, acidic Bio-D, or a pH adjusted cyanide leach liquor is treated with an at least approximately stoichiometrically equal amount of a stabilized form of sodium borohydride (e.g. 4.4M $NaBH_4$, 14M NaOH, balance water). Sodium borohydride is a strong reducing agent and its reducing action results in precipitation of metallic gold which can be removed from the raffinate by filtration, washed with distilled water and heated to about 1200° C. to obtain high purity gold beads. The barren raffinate can then be recycled for reuse.

The reduction precipitation proceeds according to the following reactions:

$$NaBH_4 + 2H_2O \rightarrow NaBO_2 + 8H^+ + 8e^- \quad (1)$$

$$8Au^+ + 8e^- \rightarrow 8Au^o \quad (2)$$

In the absence of any reducible species in solution; sodium borohydride decomposes into sodium metaborate and hydrogen gas:

$$NaBH_4 + 2H_2O \rightarrow NaBO_2 + 4H_2 \quad (3)$$

It will be apparent from equations (1) and (2) that ideally eight moles of monovalent gold would be reduced to metallic gold with one mole of sodium borohydride.

DESCRIPTION OF THE PREFERRED EMBODIMENTS

In a preferred embodiment, gold ore or gold concentrate is leached with acidic thiourea solution. The solids are separated from the pregnant solution which is then subjected to reduction precipitation by the addition of stabilized sodium borohydride. The gold powder is recovered by filtration, washing and then heating to about 1200° C. The barren solution can be recycled to the leach. The sodium borohydride can be stabilized by the addition of alkali, such as sodium hydroxide.

In another preferred embodiment, acidic Bio-D rather than thiourea is used as a lixiviant. This lixiviant is a mixture of 1,3-dibromo 5,5-dimethyl hydantoin and sodium bromide, marketed by Bahamian Refining Corporation of Phoenix, Ariz.

Naturally, the stabilized form of sodium borohydride may be employed as a reductant in the final steps of already established and commercially viable gold recovery processes.

The following Examples further illustrate the invention.

EXAMPLE 1

An alkali cyanide leach liquor containing the following metal values was treated:

| Element | Ppm |
|---|---|
| Au | 53 |
| Ag | 8 |
| Fe | 88 |
| Cu | 180 |
| Ni | 15 |

Fourteen liters of this gold-cyanide leach liquor was added to an appropriately sized beaker. Over a period of 65 minutes, 100 ml of stabilized sodium borohydride (4.4M in 14M NaOH) was added dropwise at room temperature to the stirred contents of the beaker. The precipitation of metals commenced almost immediately with evolution of hydrogen gas. Since the precipitation of metals was very slow, the pH of the leach liquor was lowered to 3.0–3.5 by the addition of $H_2SO_4$. The rate of precipitation of metals increased immediately. Upon analysis, the raffinate was found to have the following composition:

| Element | Ppm | Percent Extraction |
|---|---|---|
| Au | 0.4 | 99% |
| Ag | 0.1 | 99% |
| Fe | 24.0 | 73% |
| Cu | 0.5 | 97% |
| Ni | 0.4 | 97% |

EXAMPLE 2

An acidic gold-thiourea leach liquor containing the following elements was treated at pH 1.5–2.0:

| Element | Ppm |
|---|---|
| Au | 14.8 |
| Ag | 0.5 |
| Fe | 6.6 (g/l) |
| Cu | 60 |

Fourteen liters of the gold-thiourea leach liquor was added to an appropriately sized beaker. Over a period of 60 minutes, 100 ml of stabilized sodium borohydride (4.4M in 14M NaOH) was added dropwise to the stirred contents of the beaker. Precipitation of metals started almost immediately with the evolution of hydrogen gas. No pH adjustment was required. The precipitates were separated from the raffinate by filtration, leaving the barren solution reusable. The spongy and heavy precipitates were washed several times with distilled water and then heated in a porcelain crucible at high temperature (about 1200° C.). Metallic gold beads appeared in the molten mass. Upon analysis, the raffinate was found to contain the following:

| Element | Ppm | Percent Extraction |
|---|---|---|
| Au | 1.0 | 93% |
| Ag | trace | c.a. 99% |
| Fe | 2.29 (g/l) | 96% |
| Cu | 0 | 100% |

EXAMPLE 3

An acidic gold-Bio-D leach liquor containing the following metal values was treated:

| Element | Ppm |
|---|---|
| Au | 2 |
| Ag | 1 |
| Fe | 2.0 (g/l) |
| Cu | 42 |

One liter of the gold-Bio-D leach liquor (pH 4.5) was added to an appropriately sized beaker. 3 to 4 milliliters of stabilized sodium borohydride (4.4M in 14M NaOH) were added dropwise to the stirred contents of the beaker. Precipitation of the metals began almost immediately with the evolution of hydrogen gas. No pH adjustment was required. The precipitates were separated from the raffinate by filtration, leaving the relatively barren Bio-D solution reusable. The spongy and heavy precipitates were washed several times with distilled water and then heated in a porcelain crucible at high temperature (about 1200° C.). Metallic gold beads appeared in the molten mass. Upon analysis, the raffinate contained the following:

| Element | Ppm | Percent Extraction |
|---|---|---|
| Au | trace | c.a. 99% |
| Ag | trace | c.a. 99% |
| Fe | 0 | 100% |
| Cu | 2.8 | 93% |

The test data in each of the above Examples indicate that almost complete precipitation of gold (9% or above) is possible from the pH adjusted cyanide leach liquor as well as from the Bio-D leach liquor and acid thiourea leach liquor. Almost quantitative precipitation of gold would be possible from acidic thiourea leach liquor by selecting suitable conditions for precipitation. These test data further indicate that silver precipitation was essentially quantitative from all these three kinds of leach liquors. The high iron level in the acidic thiourea leach liquor was due to the addition of $Fe^{+3}$ as an oxidant during leaching.

I claim:

1. A process for recovering metallic gold from an acidic solution containing gold values, which comprises:

adding to the solution a stabilized sodium borohydride comprising a mixture of sodium borohydride and sodium hydroxide in an amount at least stoichiometrically equal to the amount of gold compounds in solution to cause precipitation;

separating the metallic precipitate from the solution; and heating the precipitate to obtain high purity metallic gold.

2. A process as claimed in claim 1, wherein the acidic solution comprises a pH adjusted cyanide leach liquor, an acidic thiourea liquor or a leach liquor comprising a mixture of 1,3-dibromo 5,5-dimethyl hydantoin and sodium bromide.

3. A process as claimed in claim 1, wherein the gold-containing solution is leach liquor obtained from the alkali cyanide extraction of gold ore or gold concentrate.

4. A process as claimed in claim 1, wherein the acidic solution is obtained in the final recovery step of a gold ore or gold concentrate cyanidation solvent extraction followed by stripping of the organic phase by acidified thiourea.

5. A process as claimed in claim 1, wherein heating of the precipitate is effected to a temperature of at least about 1200° C.

6. A process for recovering metallic gold from an acidic solution containing gold values, which comprises:

adding to the solution a stabilized alkali borohydride in an amount at least stoichiometrically equal to the amount of gold compounds in solution to cause precipitation;

separating the metallic precipitate from the solution; and heating the precipitate to obtain high purity metallic gold;

wherein the stabilized alkali borohydride is a stabilized alkali metal borohydride or ammonium borohydride;

wherein the stabilized alkali borohydride employed is stabilized sodium borohydride; and wherein the stabilized sodium borohydride comprises a mixture of sodium borohydride and sodium hydroxide.

7. A process as claimed in claim 6, wherein the acidic solution comprises a pH adjusted cyanide leach liquor, an acidic thiourea liquor or a leach liquor comprising a mixture of 1,3-dibromo 5,5-dimethyl hydantoin and sodium bromide.

8. A process as claimed in claim 6, wherein the gold-containing solution is leach liquor obtained from the alkali cyanide extraction of gold ore or gold concentrate.

9. A process as claimed in claim 6, wherein the acidic solution is obtained in the final recovery step of a gold ore or gold concentrate cyanidation solvent extraction followed by stripping of the organic phase by acidified thiourea.

10. A process as claimed in claim 6, wherein heating of the precipitate is effected to a temperature of at least about 1200° C.

* * * * *